US006881890B2

(12) United States Patent
Sakurada

(10) Patent No.: US 6,881,890 B2
(45) Date of Patent: Apr. 19, 2005

(54) MUSICAL TONE GENERATING APPARATUS AND METHOD FOR GENERATING MUSICAL TONE ON THE BASIS OF DETECTION OF PITCH OF INPUT VIBRATION SIGNAL

(75) Inventor: Shinya Sakurada, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/746,316

(22) Filed: Dec. 23, 2003

(65) Prior Publication Data

US 2004/0144239 A1 Jul. 29, 2004

(30) Foreign Application Priority Data

Dec. 27, 2002 (JP) ..... 2002-381212

(51) Int. Cl.[7] ..... G10H 5/00
(52) U.S. Cl. ..... 84/654; 84/662
(58) Field of Search ..... 84/616, 626, 654, 84/662

(56) References Cited

U.S. PATENT DOCUMENTS 6,372,973 B1 * 4/2002 Schneider ..... 84/609
6,653,546 B1 * 11/2003 Jameson ..... 84/735

* cited by examiner

*Primary Examiner*—Jeffrey W Donels
(74) *Attorney, Agent, or Firm*—Morrison & Foerster LLP

(57) ABSTRACT

A vibration signal (e.g. a human voice) is generated at a desired pitch corresponding to a tone pitch of a musical tone desired to be generated, and is input via a microphone. The pitch of the input vibration signal and an amplitude (volume) level thereof are detected. When an amplitude level equal to or greater than a predetermined threshold level has been detected but the pitch has not been detected yet, an instruction of generation of a noise tone is issued thereby to generate the noise tone. Thereafter, when a certain pitch is detected, a musical tone is generated at a pitch determined according to the detected pitch. In this way, a noise tone is generated during a delay in pitch detection, and a delay in response at the start of sounding is absorbed.

10 Claims, 7 Drawing Sheets

MUSICAL TONE GENERATING APPARATUS AND METHOD FOR GENERATING MUSICAL TONE ON THE BASIS OF DETECTION OF PITCH OF INPUT VIBRATION SIGNAL

BACKGROUND OF THE INVENTION

1. Field of the Invention

The present invention relates to a musical tone generating apparatus and method which can be suitably applied to an electronic wind instrument, etc., and which generates a musical tone according to a detected pitch of an input vibration signal (such as that of a human voice).

2. Description of the Prior Art

As is known, a human player blows a natural (acoustic) wind instrument to vibrate air (air column) in a tube to generate musical tones. For example, when blowing a trumpet, the player strains his/her upper and lower lips pressed against a mouthpiece and blows air with great force through a gap between the strained lips, thus vibrating air column within a tube. On this occasion, degree in which the lips pressed against the mouthpiece are strained is properly increased or decreased (i.e. this is called "embouchure") to generate a desired harmonic tone and adjust the tone quality. By the way, a natural wind instrument such as a trumpet has the problem that a musical tone with a substantial pitch cannot be sounded in a stable manner unless the air expired from the player has a sufficient pressure (expiratory pressure). Therefore, in the case where the expiratory pressure is very low or embouchure is not properly carried out, it is difficult to sound a correct musical tone. For example, in a moment immediately after the start of blowing, an expiratory pressure enough to sound a musical tone cannot be obtained, and hence the expiratory leaks first and then a substantial musical tone is sounded with an increase in expiratory pressure. For this reason, the player of a trumpet or the like usually starts sounding (for example, the player carries out embouchure and blows in a trumpet) earlier than timing at which a musical tone should be actually sounded, thereby adjusting musical tone sounding timing. Further, in wind instruments such as a flute and a trumpet, a breath tone produced during sounding is part of tonal characteristic of such instruments.

Electronic musical instrument has been known which detects a pitch included in a vibration generated physically by input of sound (expiratory) or operation of a performance operator such as plucking of a string by the player, and sounds an electronic sound signal in a tonal scale corresponding to the detected pitch. This type of electronic musical instrument takes a long period of time to accurately detect the pitch of an input vibration signal, and hence has the problem that sounding cannot be quickly started in response to the input of a vibration signal, and a natural musical tone cannot be generated during a performance. Therefore, for example, when strings of an electronic guitar (synthesizer guitar) are plucked, musical tones are generated at a predetermined pitch corresponding to plucked open strings while the pitch of an input signal is not detected, and thereafter, once the pitch is detected, musical tones are generated at the detected pitch so that the responsiveness can be improved (refer to Japanese Patent No. 2,508,035, for example).

SUMMARY OF THE INVENTION

It is therefore an object of the present invention to provide a musical tone generating apparatus and method which can increase a speed of response at which sounding is started in response to the input of a vibration signal. Also, it is an object of the present invention to provide a musical tone generating apparatus and method which permit generation of more natural musical tones.

To attain the above object, in a first aspect of the present invention, there is provided a musical tone generating apparatus comprising an input section that inputs a vibration signal, a pitch detecting section that detects a pitch of the input vibration signal, a level detecting section that detects an amplitude level of the input vibration signal, a noise sounding instructing section that instructs generation of a noise tone when the level detecting section has detected an amplitude level equal to or greater than a predetermined threshold value but the pitch detecting section has not yet detected the pitch, and a musical tone pitch determining section that determines a pitch of a musical tone to be generated according to the pitch detected by the pitch detecting section.

With this arrangement, in the case where the level detecting section has detected an amplitude level equal to or greater than a predetermined threshold value but the pitch detecting section has not yet detected the pitch, the noise sounding instructing section gives an instruction for sounding a noise tone. Therefore, even when the pitch of the input vibration signal has not been determined, sounding of a noise tone can be started insofar as an amplitude level equal to or greater than the threshold value has been detected. As a result, the invention permits generation of a noise tone to be quickly started in response to the input of a vibration signal such as sound without having to wait for the pitch to be determined. For this reason, the player auditorily senses that sounding is quickly started in response to the input of a vibration signal even if pitch detection is not actually expedited. Further, a noise tone can be sounded in a delicate manner at the beginning of sounding from a wind instrument.

To attain the above object, in a second aspect of the present invention, there is provided a musical tone generating apparatus comprising an input section that inputs a vibration signal, a pitch detecting section that detects a pitch of the input vibration signal, a performance operator unit, and a musical tone pitch determining section that determines a pitch of a musical tone to be generated in accordance with at least one of the pitch detected by the pitch detecting section and an operating state of said performance operator unit, wherein the musical tone pitch determining section determines a pitch of a musical tone to be generated in accordance with the operating state of the performance operator when the pitch detecting section has not detected the pitch.

With this arrangement, in the case where a human voice is input as a vibration signal, and even if the voice is sounded at a pitch which is incorrect to some extent, a desired pitch or note can be specified in a limited way by operation of the performance operator. For example, when playing a trumpet, the player adjusts the vibration pitch using his/her lips so that the pitch of a musical tone can be different even when the trumpet is fingered in the same manner. This requires a high-level technique difficult for a beginner. With the performance operator unit of a trumpet type according to the present invention, however, even a beginner can perform music in a way which requires a high-level technique as described above by just only generating sound at a desired pitch and fingering pistons in a predetermined manner.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

FIGS. 4A and 4B are waveform charts, of which FIG. 4A shows an example of a sound waveform input to the musical tone generating apparatus in FIG. 1, and FIG. 4B shows an example of a clip waveform obtained by shaping the sound waveform in FIG. 4A;

DETAILED DESCRIPTION OF THE PREFERRED EMBODIMENTS

The present invention will now be described in detail with reference to the drawings showing preferred embodiments thereof.

Figure 1:
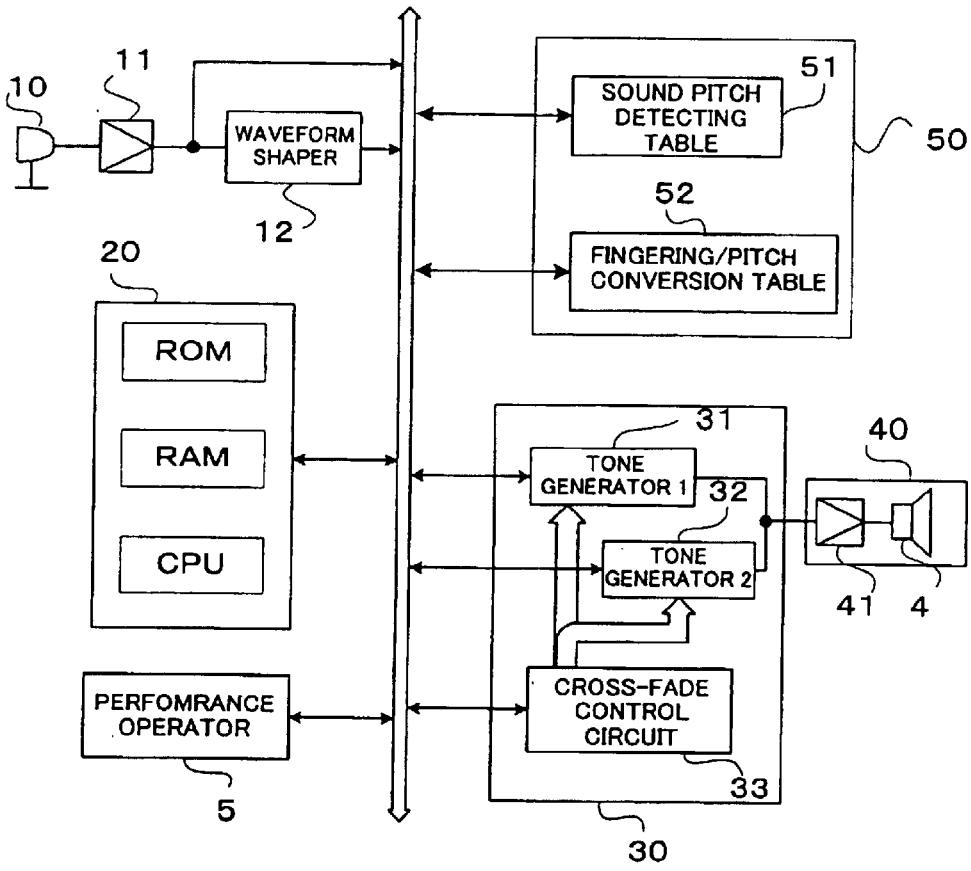
FIG. 1 is a block diagram showing the system configuration of a musical tone generating apparatus according to an embodiment of the present invention.
Figure 2:
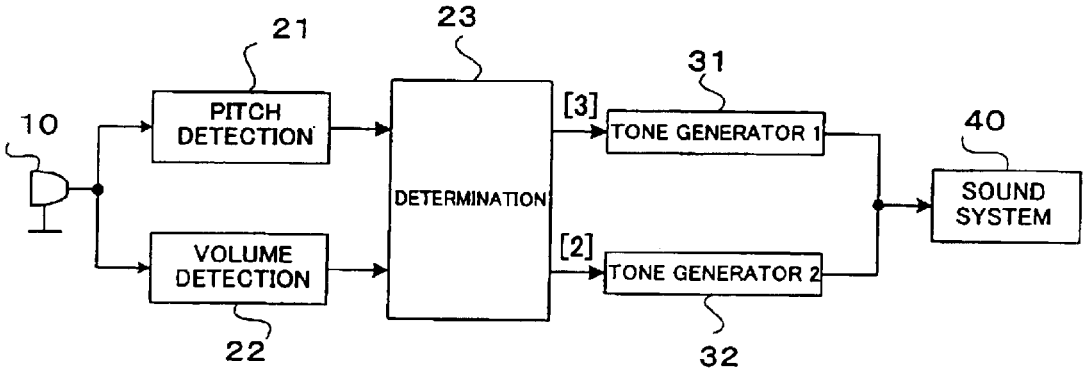
FIG. 2 is a block diagram showing functional blocks relating to a sounding process carried out by the musical tone generating apparatus according to the embodiment.
Figure 3:
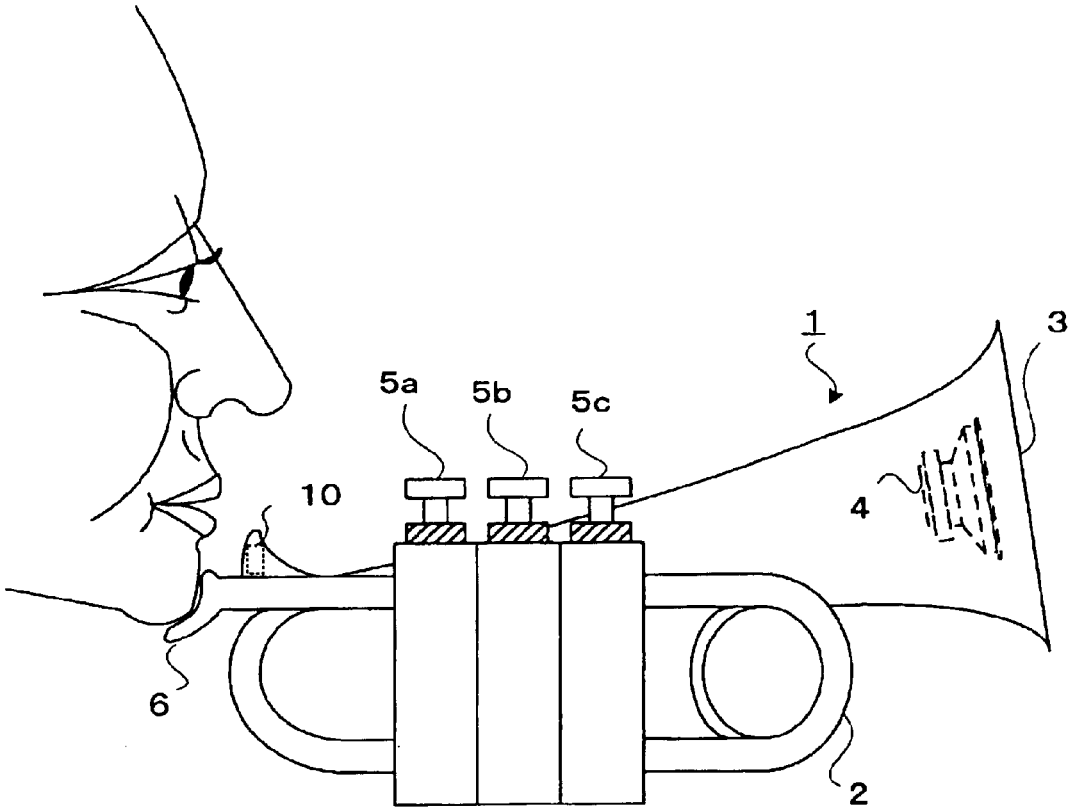
FIG. 3 is a side view schematically showing the appearance of an electronic trumpet to which the musical tone generating apparatus in FIG. 1 can be applied.

FIG. 1 is a block diagram showing the system configuration of a musical tone generating apparatus according to an embodiment of the present invention. The musical tone generating apparatus is provided in, for example, an electronic musical instrument (electronic trumpet) as shown in FIG. 3. FIG. 2 is a block diagram schematically showing functional blocks related to a sounding process carried out by the musical tone generating apparatus. As shown in FIG. 1, the musical tone generating apparatus includes an input device 10, e.g. a microphone or a pickup device, for capturing a vibration signal, a controller 20, a tone generator unit 30, a sound system 40, a performance operator 5, and a pitch detecting block 50.

The input device 10 is an aerial vibration detecting device which is implemented by, for example, a piezoelectric element attached to a microphone or a thin plate, and converts the aerial vibration of a sound or the like generated by the player, into an electric signal. The controller 20 includes a CPU, a ROM, and a RAM, and controls all operations of the musical tone generating apparatus; e.g., the controller 20 performs processing for detecting operation of the performance operator 5, and processing for controlling sounding or audible production of musical tones.

The tone generator unit 30 includes a first tone generator 31 for generating musical tones, and a second tone generator 32 for generating noise tones. The first tone generator 31 may be based on any known tone generation method such as a waveform memory method. The second tone generator 32 for sounding noise tones may be implemented by a noise generator which generates white noises or the like. In this case, noise tones which are generated may be processed in an appropriate manner (for example, by cutting out harmonic components). Further, the second tone generator 32 may include a memory which stores PCM-coded breath tones generated through a flute, a trumpet, or the like, and any of different types of tone generators for generating noise tones may be selectively used. In this case, any known tone generation method, such as the waveform memory method, may be used. It should be noted that each of the first tone generator 31 and the second tone generator 32 may be implemented by a hardware tone generator board or may be implemented by a software tone generator program. Musical tone/noise tone signals generated by the first tone generator 31 and the second tone generator 32 are digital-to-analog converted and then sounded via the sound system 40 including an amplifier 41 and a speaker 4.

A cross-fade control circuit 33 included in the tone generator unit 30 controls the first tone generator 31 and the second tone generator 32 according to control signals supplied from the controller 20, and carries out cross-fade processing when the tone generators to be used is switched from one to another.

The pitch detecting block 50 includes a sound pitch detecting table 51 and a fingering/pitch conversion table 52, and as described later, detects the pitch of a vibration signal indicative of a sound input from the input device 10, and determines the pitch of a musical tone to be sounded according to fingering of the performance operator 5 and the sound pitch.

The sounding process carried out by the musical tone generating apparatus according to the present embodiment will now be outlined by reference to FIG. 2. First, a vibration signal indicative of a sound or the like input from the input device 10 is supplied to a pitch detecting means 21 and a volume detecting means 22. The pitch detecting means 21 detects the pitch of the input vibration signal. The volume detecting means 22 detects the amplitude level of the input vibration signal. A determination means 23 determines whether or not the pitch has been detected by the pitch detecting means 21, and determines sounding conditions according to the amplitude level detected by the volume detecting means 22. The determination of the sounding conditions means a determination as to which processing should be executed from among the following: [1] processing for keeping silence (sounding is not performed); [2] processing where a noise tone is sounded; and [3] processing where the pitch of a musical tone to be generated is determined according to the detected pitch of the vibration signal, and the musical tone is then sounded. An instruction corresponding to the result of the determination is transmitted from the controller 20 to the tone generator unit 30. According to the result of the determination made by the determination means 23, the controller 20 instructs the first tone generator 31 or the second tone generator 32 to start/end sounding, i.e., gives an instruction for sounding/muting a tone (musical tone or noise tone) which should be sounded.

Specifically, if the pitch has been determined by the pitch detecting means 21, the result of the determination is that "[3] a musical tone is sounded", and an instruction for sounding a musical tone is transmitted to the first tone generator 31. On the other hand, if an amplitude level equal to or greater than a predetermined threshold level has been detected by the volume detecting means 22 but the pitch has not yet been detected by the pitch detecting means 21, the result of the determination is that "[2] a noise tone is sounded", and an instruction for sounding a noise tone is transmitted to the second tone generator 32. The predetermined threshold level is set to a suitable amplitude level value for determining that the input of a vibration signal to the input device 10 has been definitely started (rise in input vibration signal).

As described previously, it takes a relatively long time to detect (determined) the pitch of a vibration signal, while it takes a relatively short time to detect the amplitude level. For this reason, typically, when the amplitude level of an input vibration signal becomes equal to or greater than a predetermined threshold level, sounding of a noise tone via the tone generator 32 is started, and thereafter, when the pitch is detected, a musical tone with a pitch corresponding to the detected pitch is sounded, instead of the noise tone, via the tone generator 31.

It should be noted that various kinds of processing performed by the pitch detecting means 21, volume detecting means 22, and determination means 23 are implemented by execution of predetermined software using the controller 20 appearing in FIG. 1. However, such processing may be implemented not only as computer software but also by microprograms executed by a DSP (Digital Signal Processor), and may be implemented by a dedicated hardware device which performs the functions of the pitch detecting means 21, volume detecting means 22, and determination means 23.

Referring to FIG. 3, a brief description will now be given of the appearance of an electronic trumpet to which the musical tone generating apparatus according to the present embodiment can be suitably applied. An electronic trumpet 1 in FIG. 3 has a main body 2 which is cone-shaped to imitate a trumpet as a natural instrument, and a flaring bell 3 is formed at one end of the main body 2. In the flaring bell 3, the speaker 4 is disposed to face outwardly. The input device 10 is disposed on an upper surface of the other end (on the near side as viewed from the player of the trumpet) of the main body 2. A first performance piston 5*a*, a second performance piston 5*b*, and a third performance piston 5*c*, which constitute the performance operator 5, are disposed at an upper part of the central part of the main body 2. The first to third pistons 5*a* to 5*c* are switches which are configured like pistons provided in a trumpet as a natural musical instrument, so that the pitch of a musical tone to be sounded can be designated according to a combination of depressed ones of the switches (i.e. fingering). A switch operation event according to fingering of the pistons 5*a* to 5*c* is supplied to the controller 20 shown in FIG. 1. Further, a chin rest 6, which is shaped to fit a human chin, is formed at a lower part of the player-side end of the main body 2. When the player abuts his/her chin against the chin rest 6 as shown in FIG. 3 to hold the electronic trumpet 1, the input device 1 is positioned in front of his/her mouth.

The player inputs a melody, a musical tone, or the like, which is to be played, to the input device 10 using his or her voice. In this case, the player may hum a desired melody, musical tone, or the like with an arbitrary voice such as "Ah" or "Uh", or by singing lyrics of a musical composition to be played. Also, when inputting sound, the player may intentionally input a voice including no pitch element (for example, an onomatopoeic sound such as "Tiyu Tiyu" or "Shuh Shuh") and then input a sound including a pitch element (such as a melody or a musical tone). In this way, at the initial stage of sounding via the electronic trumpet 1 according to the present invention, it is possible to intentionally sound a rough noise tone and then sound a normal musical tone with a pitch as described later. The pitch of a musical tone which can be sounded from the electronic trumpet 1 is determined in dependence on a combination of sound pitch detection data based on the detected pitch of an input sound (vibration signal) and the fingering state of the first to third performance pistons 5*a* to 5*c*. It should be noted that the pistons 5*a* to 5*c* are preferably configured such that when the player releases them, they are forced upward by a spring, a stopper mechanism, or an actuator so that they can be returned to unpressed positions as shown in FIG. 3.

Figure 4:
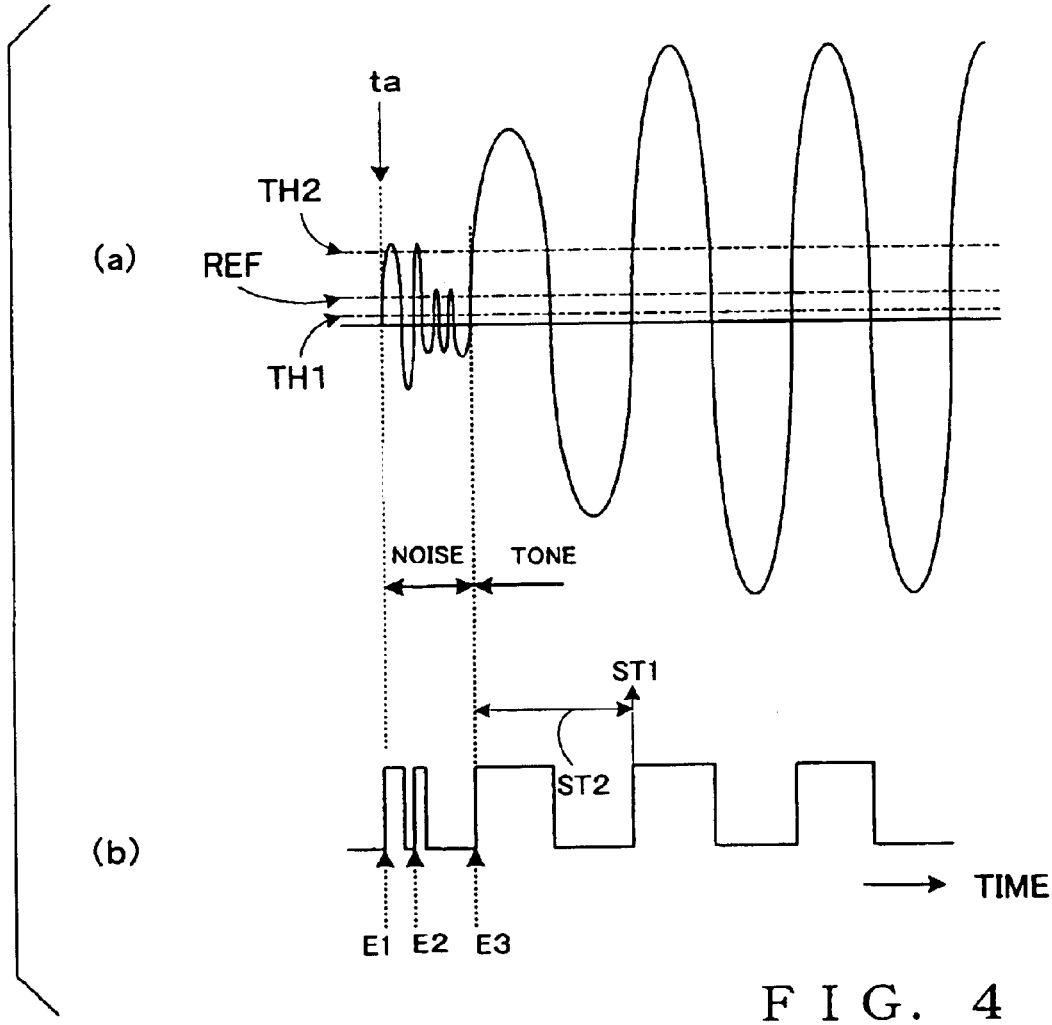

Referring again to FIG. 3, the sound (electric vibration signal) input via the input device 10 is amplified by an amplifier 11 and input to a waveform shaper 12. The waveform shaper 12 waveform-shapes the input signal to generate a clip waveform. The generated clip waveform is supplied to the controller 20, and is used for detecting the pitch of the input sound. As shown in FIG. 1, in the musical tone generating apparatus according to the present embodiment, an electric vibration signal (raw waveform) which is not input to the waveform shaper 12 is also analog-to-digital converted appropriately and supplied to the controller 20. A signal (raw waveform) which is not shaped into a clip waveform can be used for the controller 20 to e.g. detect the amplitude level and provide temporal control of a volume envelope. FIG. 4A is a waveform chart showing an example of an input sound (raw waveform), showing e.g. a waveform beginning from a time point the player inputs a sound. FIG. 4B is a waveform chart showing a clip waveform obtained by waveform-shaping the input sound in FIG. 4A. The clip waveform is comprised of a signal which is obtained by synchronizing the input vibration signal with its zero-cross point and waveform-shaping it into pulse.

A brief description will now be given of an example of a sound pitch detecting process. The controller 20 measures (counts) a time period corresponding to each periodic waveform of a clip waveform. The measured time period (count value) is stored as periodic data T in a periodic data register. When counting of periodic data is started on the leading edge of each periodic waveform of the clip waveform, periodic data T measured for an immediately preceding period is stored as previous periodic data Tpre in a previous periodic data register. Then, the periodic data T stored in the periodic data register at present and the previous periodic data Tpre stored in the previous periodic data register are compared with each other. If they substantially coincide with each other, the periodic data T is detected (assumed) as the period of a currently input sound (vibration signal).

According to the detected periodic data T, corresponding sound pitch detection data PIT is determined by referring to the sound pitch detecting table 51. The determined sound pitch detection data PIT is stored in a sound pitch register. When the latest sound pitch detection data PIT is loaded into the sound pitch register, sound pitch detection data PIT having been registered since then is stored as previous pitch data PITpre in a previous sound pitch register. The sound pitch detection data PIT and the previous pitch data PITpre are compared with each other, and if they substantially coincide with each other, the sound pitch detection data PIT is determined to be sound pitch detection data on the input sound, and the controller 20 then sets a sound pitch determination flag PITon to "1", which indicates that the pitch of the input vibration signal (sound) has been detected. Thus, when the flag PITon is not set to "1", the controller 20 recognizes that the pitch has not yet been detected. The determined sound pitch detection data PIT is used as a reference input for the fingering/pitch conversion table 52.

The fingering/pitch conversion table 52 is a table which shows the relationship between sound pitches and fingering states of the performance pistons 5*a* to 5*c*. The sound pitch detection data PIT output from the sound pitch detection table 51 and the fingering state of the first to third performance pistons 5*a* to 5*c* operated by the player are used as reference inputs for the fingering/pitch conversion table 52. By referring to the fingering/pitch conversion table 52, the pitch of a musical tone to be generated by the first tone generator 31, which is for generating musical tones, is determined according to a combination of the detected sound pitch and the fingering state of the pistons 5*a* to 5*c*. The controller 20 transmits pitch data indicative of the pitch determined referring to the fingering/pitch conversion table 52 to the first tone generator 31, which is for generating musical tones, to specify the pitch of a musical tone to be sounded (such as the name of a tonal scale) by the musical tone generating apparatus. The fingering/pitch conversion table 52 is stored in the ROM or the RAM which is referred to by the controller 20. It should be noted that the fingering/pitch conversion table 52 is preferably created as a data table which shows combinations of the fingering state and the sound pitch which determine one pitch data with a permissible range of differences in frequency of sound pitch so that high strictness can be inhibited from being required when sound is input. With this arrangement, insofar as a sound is input at a pitch within a predetermined frequency range with respect to a sound pitch which should be input in order to determine certain pitch data, desired pitch data can be determined according to a combination of the fingering state of the performance pistons 5*a* to 5*c* and the sound pitch which should be input, even if the sound is not input at a proper pitch. Therefore, even the player who does not have a good ear for music can easily play the electronic trumpet.

Figure 5:
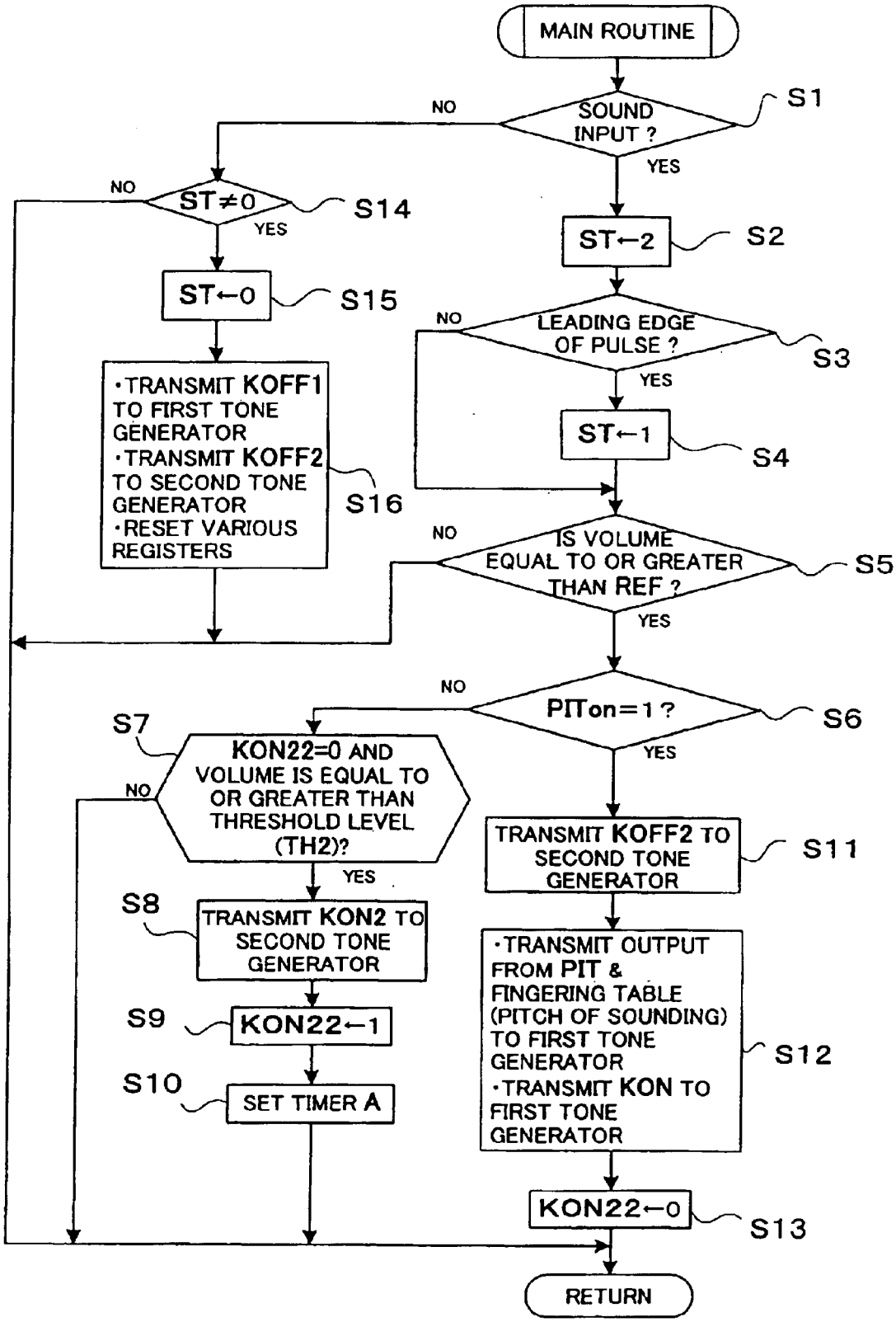
FIG. 5 is a flow chart showing an example of a main process carried out by a controller according to the embodiment.
Figure 6:
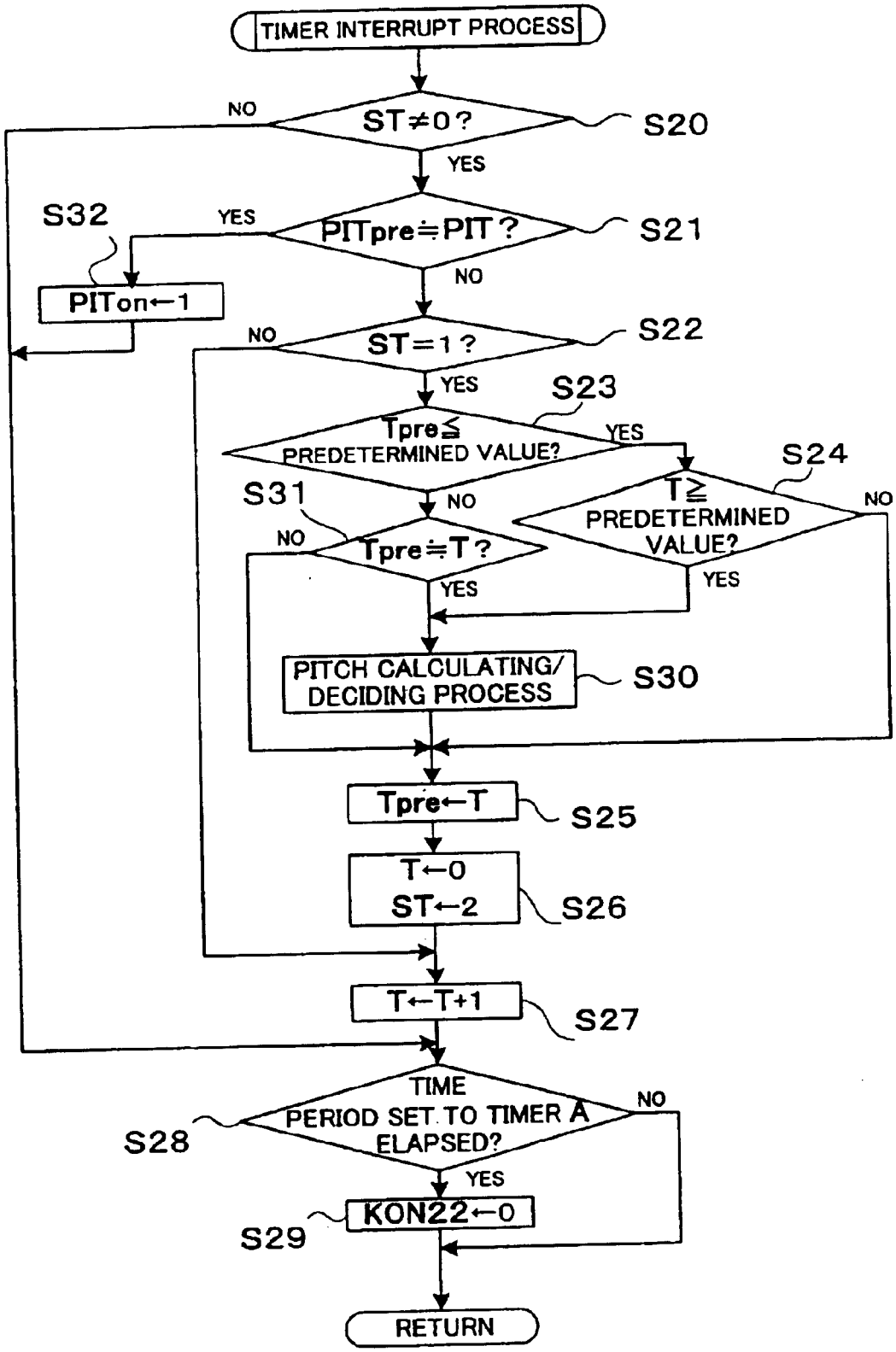
FIG. 6 is a flow chart showing an example of a timer interrupt process for detecting sound pitch detection data according to the embodiment.

Next, examples of the pitch detecting process and the sounding process carried out by the musical tone generating process will be concretely described with reference to FIG. 5 showing an example of a main routine executed by the controller 20 and FIG. 6 showing an example of an interrupt process. A flag ST which assumes three states, i.e. "0", "1", and "2" is used to control the pitch detecting process and the sounding process, and hence a description will be given of the flag ST first. The flag ST which is set to "0" indicates a state in which no sound (vibration signal) has been input, the flag ST which is set to "1" indicates a state in which pulse of a clip waveform which is waveform-shaped by the waveform shaper 12 has risen, and the flag ST which is set to "2" indicates a state other than the state indicated by the flag ST set to "0" with a sound (vibration signal) being input. FIG. 4B shows an example of the relationship between the clip waveform and the flag ST set to "1" and "2".

In FIG. 5, it is determined in a step S1 whether or not the amplitude level of an input sound is equal to or greater than a predetermined threshold level TH1 for determining whether a sound has been input or not. If the determination result is positive (YES), the process proceeds to a step S2 wherein the flag ST is set to "2". FIG. 4A shows an example of the threshold level TH1, which can be set to a quite small value. Then, in a step S3, it is determined whether or not pulse of a clip waveform signal has risen from "0" to "1" at present, and if the determination result is positive (YES), the flag ST is set to "1" in a step S4.

In a step S5, the volume, i.e. the amplitude level of the input sound (vibration signal) is detected, and it is determined whether or not the detected amplitude level is equal to or greater than a predetermined reference value REF. The predetermined reference value REF is a reference level for determining whether to start the sounding process including the pitch detecting process, and is set to a relatively small value which is somewhat larger than the above-mentioned threshold level TH1 as shown in FIG. 4A. If the determination result in the step S5 is positive (YES), the process proceeds to a step S6 so as to carry out sounding of a musical tone or a noise tone. It should be noted that, if the detected amplitude level is equal to or smaller than the reference value REF, the process returns, so that the sounding process can be prevented from started when the amplitude level of the input signal is excessively small. Therefore, the processing efficiency can be improved.

In the step S6, it is determined whether the pitch determination flag PITon is set to "1" or not. If the determination result is positive (YES), the process proceeds to a step S11 and subsequent steps so as to carry out sounding of a musical tone. On the other hand, if the determination result is negative (NO), it is determined that the pitch has not yet been detected (the pitch is being now detected), and the process proceeds to a step S7.

To control sounding of a noise tone in the step S7 and the subsequent steps, a flag KON22 indicative of whether or not an instruction signal KON2 indicative of an instruction for starting noise sounding has been transmitted to the second tone generator 32 is used, and hence a description will be given of the flag KON22 first. The flag KON22 which is set to "0" indicates that the instruction signal KON2 indicative of an instruction for starting noise sounding has not yet been transmitted, and the flag KON22 which is set to "1" indicates that the instruction signal KON2 indicative of an instruction for starting noise sounding has already been transmitted and a noise tone is being sounded.

In the step S7, it is determined whether or not the flag KON22 is set to "0" and the detected amplitude level is equal to or greater than a predetermined threshold level. If the determination result is positive (YES), the process proceeds to a step S8 wherein the instruction signal KO2 indicative of an instruction for starting noise sounding is transmitted to the second tone generator 32 so as to instruct the tone generator 32 to generate a noise tone. Then, in a step S9, the flag KO22 is set to "1". Next, in a step S10, a predetermined timer A is set (i.e., the timer A is caused to start clocking). The timer A is for resetting the flag KO22 set to "1" upon the lapse of a predetermined time period, which may be variably set as described later.

In FIG. 4A, "TH2" denotes an example of the above-mentioned predetermined threshold level, which is appropriately set to be greater than the predetermined reference value REF as a reference level for determining whether to start the sounding process including the pitch detecting process. In the example shown in FIG. 4A, the level of the input sound exceeds the threshold level TH2 at a time point ta, and generation of a noise tone is started at the time point ta.

A description will now be given of an example of a procedure for determining sound pitch detection data on an input sound (setting the flag PITon to "1") with reference to FIG. 6 showing the timer interrupt process for measuring periodic data T. The interrupt process is carried out in predetermined clock interrupt timing. For example, even in the case where it is assumed that the highest soprano sound (about 1,000 Hz) is input, if the interrupt process is carried out at intervals of 1 $\mu$s, periodic data T can be measured with high reliability since one periodic waveform of a clip waveform can be counted based on 1,000 pulses.

In FIG. 6, if it is determined in a step S20 that the flag ST is not set to "0" (YES), the process proceeds to a step S21 wherein it is determined whether or not sound pitch detection data PIT stored at present in a predetermined sound pitch register and previously detected sound pitch detection data PITpre substantially coincide with each other. If they are equal to or smaller than a predetermined minimum value (for example, 0) and substantially coincide with each other, the determination result is negative (NO). Namely, only if they are greater than the predetermined minimum value and substantially coincide with each other, the determination result in the step S21 is positive (YES). In subsequent steps S22 to S27, pitch detection is carried out.

First, a description will be given of the pitch detecting process carried out on the first leading edge of the clip waveform, which is indicated by "E1" in FIG. 4B. In the example shown in FIG. 4B, neither previous sound pitch detection data PITpre nor present sound pitch detection data PIT is held, and hence the determination result in the step S21 is negative (NO), and the process proceeds to the step S22. In the step S22, the flag ST is set to "1" due a rise in pulse at the time point E1 (refer to the step S4 in FIG. 5), and hence the determination result in the step S22 is positive (YES), and the process proceeds to the step S23.

In the step S23, it is determined whether or not registered previous periodic data Tpre is equal to or smaller than a predetermined threshold level. Since the previous periodic data Tpre is not registered at present (i.e., a value 0 is registered), the determination result in the step S23 is positive (YES), and the process proceeds to the step S24. In the step S24, it is determined whether or not periodic data T registered at present is equal to or greater than a predetermined value (minimum value). It should be noted that, by comparing registered periodic data with a predetermined minimum value in the steps S23 and S24, the process can be inhibited from proceeding to a later pitch calculation/determination step S28 if an excessively short periodic waveform is input. Since obvious noise data is excluded from calculation/determination in the step S28, the processing efficiency can be improved. Now, the periodic data T has not yet been registered at a time point corresponding to the first leading edge E1 (i.e., a value 0 is registered), the determination result in the step S23 is negative (NO), and the process proceeds to the step S25 and subsequent steps.

In the step S25, the present periodic data T (i.e., the value 0) is stored in the previous periodic data register, and in the step S26, the present periodic data register is reset so as to prepare for starting counting of a new periodic waveform. Then, the flag ST is switched from "1" to "2". In the next step S27, the count value of the periodic data T is increased by "1". Then, in the step S28, whether a predetermined period has elapsed or not is determined by checking the timer A, and if the determination result is positive (YES), the process proceeds to a step S29. In the step S29, the flat KON22 set to "1" is reset to "0" as described above, and the interrupt process is then terminated. On the other hand, if the determination result in the step S28 is negative (NO), the interrupt process is terminated with the flag KON22 being remained at "1".

Thereafter, each time the interrupt process is carried out, the determination result in the step S22 in FIG. 6 is negative since the flag ST is set to "2", and the process proceeds to the step S27 to sequentially increase the count value of periodic data T.

Next, on the second leading edge of the clip waveform, which is indicated by E2 in FIG. 4B, the flag ST is switched from "2" to "1" in the step S4 in FIG. 5. In the first timer interrupt process after that, the determination result in the step S22 is positive (YES), and the process proceeds from the step S22 to the step S23 wherein the previous periodic data Tpre stored in the previous period register at present is referred to. Since the previous periodic data Tpre is "0", the determination result in the step S23 is positive, and the process proceeds to the step S24. In the step S24, the periodic data T stored in the periodic data register at present is referred to. Since the periodic data T counted from the first leading edge E1 to the present is stored, the determination result in the step S24 is positive (YES), and the process proceeds to a pitch calculation/determination step S30 when the periodic data T is equal to or greater than the predetermined minimum value. In the pitch calculation/determination step S30, the sound pitch detection data PIT stored in the sound pitch register is substituted for the previous sound pitch data PITpre, and the sound pitch detecting table 51 is referred to, so that new sound pitch detection data PIT corresponding to the periodic data T registered at present is determined and registered in the sound pitch register.

Then, in the step S25, the periodic data T stored in the periodic data register at present is stored as previous periodic data Pre in the previous periodic data register, and then in the steps S26 and S27, the periodic data register is reset and the flag ST is set to "2" so that counting of a new periodic waveform can be started.

Next, on the third leading edge of the clip waveform, which is indicated by E3 in FIG. 4B, the flag ST is switched from "2" to "1" in the same manner as described above in the step S4. In the step S23, it is determined that the previous periodic data Tpre is equal to or greater than the predetermined minimum value, and hence the determination result is negative (NO), and the process proceeds to a step S31. In the step S31, the registered previous periodic data Tpre and the present periodic data T are compared with each other. Since they substantially coincide with each other, the determination result is positive (YES), and the process proceeds to the pitch calculation/determination step S30. In the pitch calculation/determination step S30, the sound pitch detection data PIT stored in the sound pitch register is substituted for the previous sound pitch register PITpre, and the sound pitch detecting table 51 is referred to, so that new sound pitch detection data PIT corresponding to the currently registered periodic data T is determined and registered in the sound pitch register. On the other hand, if the sound pitch detection data PIT and the previous sound pitch register PITpre do not substantially coincide with each other (NO), the process jumps to the step S25 with the pitch calculation/determination step S30 being omitted, so that the present periodic data T is only substituted for the previous periodic data Tpre. That is, if periodic count data on adjacent periods do not substantially coincide with each other, it is determined that the pitch has been changed unstably, and hence they are excluded from determination for detecting/determining the pitch.

In the interrupt process in next interrupt riming after the pitch calculation/determination step S30 is executed in the interrupt process carried out at a time point (E3) corresponding to the third leading edge E3, the sound pitch detection data PIT having a substantial value and the present sound pitch detection data PITpre can be compared with each other. If they substantially correspond to each other, the process proceeds to a step S32 wherein the flag PITon is set to. "1", which indicates that the pitch of the input sound has been detected (the pitch has been determined). Therefore, after a sound (vibration signal) is input, the pitch can be quickly detected and determined at the time point (E3) corresponding to the third leading edge E3 of the clip waveform, but depending on the circumstances, the pitch may be detected and determined later.

Referring again to FIG. 5, a description will be given of a continued part of the sounding process. If it is determined in the step S6 that the sound pitch detection data has been determined (the flag PITon is set to "1"), the process proceeds to the step S11 wherein an instruction signal KOFF2 indicative of an instruction for ending noise sounding is transmitted to the second tone generator 32 so as to instruct the second tone generator 32 to mute a noise tone. In a step S12, pitch data output from the fingering/pitch conversion table 52 and a key-on signal KON1 indicative of an instruction for starting sounding a normal musical tone are transmitted to the first tone generator 31 so as to instruct the first tone generator 31 to generate a normal musical tone according to the determined pitch data and start sounding the tone according to the key-on signal KON1. Then, in a step S13, the flag KON22 is reset to "0". Thus, the flag KON22 set to "1" indicates that a noise tone is being generated.

In the example shown in FIG. 4A, assuming that the pitch is detected and determined at the time point E3, a noise tone is generated for a time period from the time point ta to the time point E3, and a musical tone is generated after the time point E3. Of course, when the noise tone is switched to the normal musical tone substantially at the time point E3, the cross-fade control circuit 33 (FIG. 1) provides cross-fade control such that damping of the noise tone and the leading edge of the normal musical tone is cross-faded (superposed) to realize smooth switching from the noise tone to the normal musical tone.

On the other hand, if it is determined in the step S1 that the input sound has a minimum amplitude level equal to or smaller than the threshold level TH1, and if it is determined in subsequent processing in the step S1 that the detected amplitude level is a minimum level, it is then determined that no sound has been input ("NO" in the step S1), and the process proceeds to a step S14 wherein it is checked whether the flag ST indicates a state other than a state in which a sound has been input (the flag ST=1 or 2). If the determination result is positive (YES) (the flag ST=1 or 2), the flag ST is set to "0" in a step S15, and in a step S16, a key-off signal KOFF1 and a key-off signal KOFF2 are transmitted to the first tone generator 31 and the second tone generator 32, respectively, so as to instruct the first and second tone generators 31 and 32 to stop sounding, and various data such as pitch data registered in various registers are reset. In this way, a normal musical tone signal generated by the first tone generator 31 is muted (or damped). It should be noted that the key-off signal KOFF2 is transmitted to the second tone generator 32 by way of precaution, and hence if a noise tone has already been muted, this state is maintained, and if a noise tone is being sounded, it is muted.

By the way, if the pitch of the input sound has not been detected after the instruction signal KON2 indicative of an instruction for starting noise sounding is transmitted to start sounding of a noise tone in the steps S7 and S8 and before the lapse of a predetermined time period set to the timer A, the steps S11 to S13 in FIG. 5 are not executed, and hence the flag KON22 is not reset but maintained at "1". During this period, the determination result is negative (NO) in the step S6, and the process proceeds to the step S7, and the determination result in the step S7 is negative (NO). Therefore, the instruction signal KON2 indicative of an instruction for starting noise sounding is not transmitted again. Therefore, a noise tone based on the previously transmitted instruction signal KON2 is continuously sounded. In this case, upon the lapse of a predetermined time period set to the timer A, the determination result in the step S28 in FIG. 6 is positive (YES), and the process proceeds to the step S29 wherein the flag KON22 is reset to "0". Therefore, when the process proceeds from the step S6 (NO) to the step S7 in FIG. 5, the determination result in the step S7 is positive if the detected amplitude level is equal to or greater than the predetermined threshold level, since the flag KON22 is set to "0". Hence, a new instruction signal KON2 indicative of an instruction for starting noise sounding is transmitted in the step S8, so that a noise tone is sounded according to the new instruction signal KON2 indicative of an instruction for starting noise sounding. Thus, if the player intentionally generates a sound with a pitch which cannot be easily detected for a certain time period, the pitch is not detected during this time period, and hence an instruction signal KON2 indicative of an instruction for starting noise sounding is generated at intervals of a predetermined time period set to the timer A, so that a noise tone rising at intervals of the predetermined time period can be generated. For example, if the predetermined time period set to the timer A is 0.5 second, a sound with a pitch which cannot be easily detected for approximately one second or longer is input so that a noise tone can be repeatedly sounded at intervals of the predetermined time period. By generating a noise tone in this manner, it is possible to realize a husky and rough tone color like a breath tone produced by a flute or a saxophone. Therefore, by intentionally inputting a sound including no pitch element first and then inputting a sound including a pitch element, the player can intentionally generate a tone like a breath tone produced by a flute or a saxophone on the leading edge of a musical tone. Further, since it is possible to arbitrarily and variably determine a time period set to the timer A, a rough noise tone color can be produced in a manner suited to the taste of the player.

It should be noted that in the flow chart of FIG. 5, the reference value REF used in the step S5 is set to a "small" amplitude level, but the set reference value REF may be arbitrarily changed to a value desired by the player. As a result, if the reference value REF is set to be rather small, sounding of a musical tone can be easily started even when a sound with a low volume is input, and hence this setting is suitable for a beginner who tends to input faint sound. On the other hand, if the reference value REF is set to be rather great, this is suitable for an experienced player who is able to input sound with a stable (strong) volume.

It should be noted that, although in the above described embodiment, the pitch of an input sound is detected by making a determination as to coincidence of pitch per period, this is not limitative, but may be detected by any known technique in the field of audio and sound/voice analysis such as auto-correlation, zero cross method, fast Fourier transformation, linear prediction, line spectrum pair analysis, or compound sin wave model analysis. Further, to improve the detecting efficiency, the beginning of a clip waveform may be regarded as a noise and ignored, and measurement may be started after the waveform becomes stable.

It should be understood that the present invention is not limited to the embodiment described above, but various variations of the above described embodiment may be possible without departing from the spirits of the present invention, including variations as described below, for example. For example, when a sound pitch included in an input sound has not yet been detected, a musical tone may be generated according to a pitch which is estimated according to fingering of the first to third pistons 5*a* to 5*c*. Further, with the performance operator 5 being omitted, a musical tone may be sounded according to only the detected pitch of a vibration signal.

Figure 7:
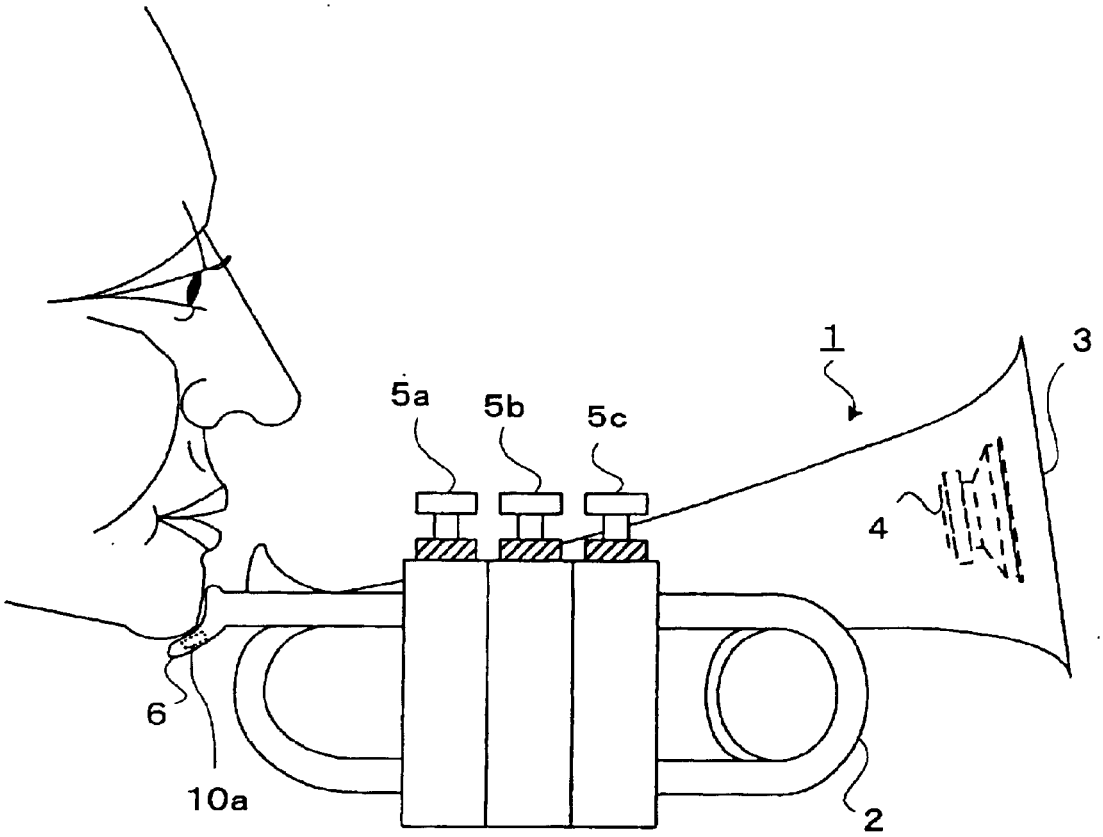
FIG. 7 is a side view schematically showing the appearance of a modification of the electronic trumpet shown in FIG. 3.
Figure 8:
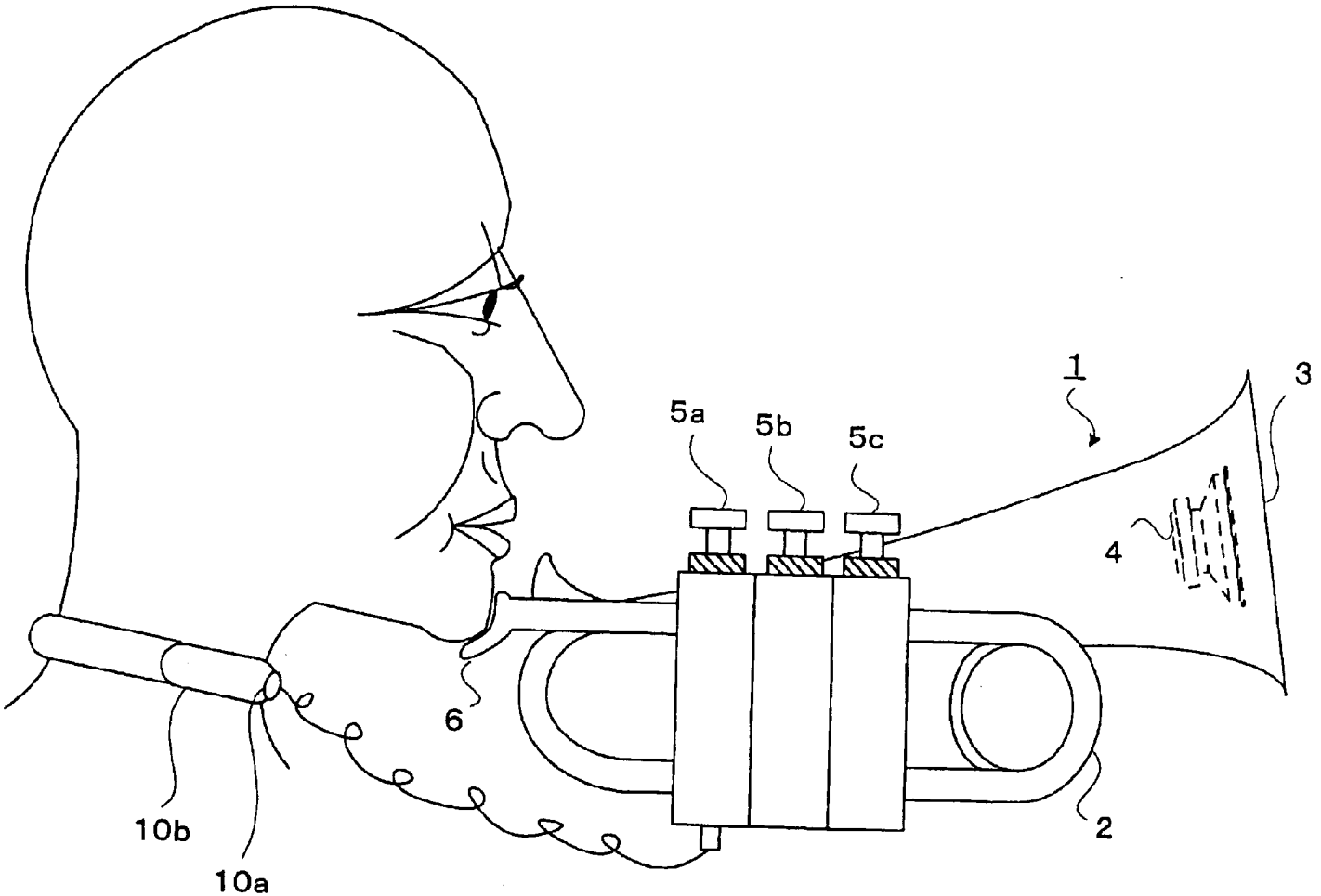
FIG. 8 is a side view schematically showing the appearance of another modification of the electronic trumpet shown in FIG. 3.

FIGS. 7 and 8 show modifications of the electronic trumpet 1 shown in FIG. 3, respectively. In the modifications, a bone conductive microphone 10*a* is provided instead of the input device 10. In the modification shown in FIG. 7, the bone conductive microphone 10*a* is incorporated into the chin rest 6 so that vibration generated in a player's vocal cords is taken up with the bone conduction microphone 10*a* through the bone of a player's jaw. On the other hand, in the other modification shown in FIG. 8, a neck belt 11*b* carrying the bone conduction microphone 10*a* is wound around a player's neck so as to make the microphone 10*a* to contact with the player's Adam's apple. In this case, vibration generated in a player's vocal cords is taken up with the bone conduction microphone 10*a* being contacted with the player's Adam's apple. The vibration signal taken up with the bone conduction microphone on the neck belt 11*b* is transmitted to the main body 2 of the electronic trumpet 1 via a wired or wireless transmission system.

Although in the above described embodiment, the musical tone generating apparatus is provided with the tone generators, this is not limitative, but it may be configured such that an electronic trumpet provided with the musical tone generating apparatus is connected to an external tone generator (such as another MIDI device), and an instruction for sounding/muting a noise tone and an instruction for sounding/muting a musical tone are given to the external tone generator (i.e., information indicative of an instruction for sounding a musical tone and information indicative of an instruction for sounding a noise tone are generated), so that sounding can be performed using the external tone generator. Further, such information indicative of instructions may be transmitted and received via a communication network.

Further, although in the above described embodiment, an electronic trumpet is taken as an example of a musical instrument to which the musical tone generating apparatus according to the present invention is applied, this is not limitative, but an electronic horn, an electronic tuba, and so forth may be used. Further, the present invention can be suitably used for various electronic musical instruments of the type which detects the pitch of an input sound (or vibration signal); e.g. an electronic wind instrument and a vocoder. Further, generation of a noise tone before sounding of a musical tone (i.e., before pitch determination) is advantageous for string type musical instruments such as an electronic violin, and in a case where a tone color produced by a pipe organ or the like, i.e. a tone color which slowly rises is produced. Of course, the present invention is not only applied to an example where a human voice is input via a microphone, but may also be applied to an example where a vibration signal is picked up from outside.

As described above, according to the present invention, even in the case where pitch detection data on an input sound has not yet been detected, a noise tone is sounded insofar as volume data indicative of a volume equal to or greater than a predetermined threshold, and therefore, the present invention can obtain such a beneficial effect that sounding is quickly started in response to the input of a sound. Further, since a noise tone is sounded before sounding of a musical tone is started, it is possible to sound natural musical tones in tone colors produced by various wind instruments, violins, organs, and so forth. Further, according to the present invention, a delay in pitch detection is hard to auditorily sense, which is desirable because it is possible to place more emphasis on detecting accuracy and stability than on detecting speed in designing the pitch detecting process.

What is claimed is:

1. A musical tone generating apparatus comprising:

an input section that inputs a vibration signal;

a pitch detecting section that detects a pitch of the input vibration signal;

a level detecting section that detects an amplitude level of the input vibration signal;

a noise sounding instructing section that instructs generation of a noise tone when said level detecting section has detected an amplitude level equal to or greater than a predetermined threshold value but said pitch detecting section has not yet detected the pitch; and a musical tone pitch determining section that determines a pitch of a musical tone to be generated according to the pitch detected by said pitch detecting section.

2. A musical tone generating apparatus according to claim 1, wherein said input section inputs a vibration signal of a human voice via a microphone.

3. A musical tone generating apparatus according to claim 1, wherein said input section picks up vibrations generated outside said musical tone generating apparatus.

4. A musical tone generating apparatus according to claim 1, further comprising:

a musical tone generator section that generates a musical tone signal indicative of the pitch determined by said musical tone pitch determining section; and a noise tone generator section that generates a noise tone signal according to the instruction from said noise sounding instructing section.

5. A musical tone generating apparatus according to claim 4, wherein a type of a noise tone to be generated by said noise tone generator section can be selected from among a plurality of different types of noise tones.

6. A musical tone generating apparatus according to claim 4, further comprising a cross-fade controller that cross-fade controls a noise tone signal and a musical tone signal when a switchover is to be made from a state in which said noise tone generator section generates the noise tone signal to a state in which said musical tone generator section generates the musical tone signal.

7. A musical tone generating apparatus according to claim 1, further comprising:

a performance operator unit; and wherein said musical tone pitch determining section determines a pitch of a musical tone to be generated in accordance with the pitch detected by said pitch detecting means and an operating state of said performance operator unit.

8. A musical tone generating apparatus according to claim 7, wherein said performance operator unit is provided to imitate performance operating elements of a trumpet.

9. A program comprised of instructions for causing a computer to execute a method of generating information related to musical tone generation according to an input vibration signal, the method comprising the steps of:

detecting a pitch of the input vibration signal;

detecting an amplitude level of the input vibration signal;

generating information for instructing generation of a noise tone when the detected amplitude level is equal to or greater than a predetermined threshold value but the pitch of the input vibration signal has not been detected; and determining a pitch of a musical tone to be generated in accordance with the pitch detected by said pitch detecting section when the pitch of the input vibration signal has been detected.

10. A musical tone generating method comprising the steps of:

detecting a pitch of the input vibration signal;

detecting an amplitude level of the input vibration signal;

generating a noise tone when the detected amplitude level is equal to or greater than a predetermined threshold value but the pitch of the input vibration signal has not been detected; and generating a musical tone according to the detected pitch of the input vibration signal when the pitch of the input vibration signal has been detected.

* * * * *